United States Patent [19]

Nottke et al.

[11] 4,194,650

[45] Mar. 25, 1980

[54] LIQUID MIXING AND AERATING SYSTEM

[75] Inventors: James E. Nottke, Seminole; Jack K. Ruebel, Clearwater, both of Fla.

[73] Assignee: Lykes Pasco Packing Co. Dispenser Manufacturing Div., Clearwater, Fla.

[21] Appl. No.: 882,658

[22] Filed: Mar. 2, 1978

Related U.S. Application Data

[62] Division of Ser. No. 768,612, Feb. 14, 1977.

[51] Int. Cl.[2] ..... B67D 1/10

[52] U.S. Cl. ..... 222/57; 222/133; 222/148; 239/428.5

[58] Field of Search ..... 222/1, 57, 129.2, 133, 222/134, 145, 148; 418/154; 417/43; 239/347, 348, 428.5

[56] References Cited

U.S. PATENT DOCUMENTS

| | | | |
|---|---|---|---|
| 3,123,252 | 3/1964 | Kuntz | 222/57 X |
| 3,191,869 | 6/1965 | Gilmour | 239/348 X |
| 3,450,350 | 6/1969 | Gullaksen | 239/428.5 |
| 3,520,448 | 7/1970 | Russell | 222/57 |
| 3,581,998 | 6/1971 | Roche | 239/428.5 X |
| 3,642,171 | 2/1972 | Ernst | 222/133 X |
| 3,829,248 | 8/1974 | Bright et al. | 418/154 X |
| 3,898,861 | 8/1975 | McMillan | 222/1 X |

*Primary Examiner*—David A. Scherbel
*Attorney, Agent, or Firm*—Stein & Frijouf

[57] ABSTRACT

A liquid mixing and aeration system is disclosed comprising a novel liquid pump, a electronic circuit for controlling the system, and improved mixing for mixing flowing liquids. The system enables mixing of a first and a second liquids regulating fthe flow of the first liquid. A liquid pump is connected for pumping the second liquid. A control circuit controls the pump in accordance with the flow of the first liquid to maintain a given volumetric relationship between the first liquid and the second liquid. A mixer mixes the first and second liquid in accordance with the aforementioned volumetric relationship.

7 Claims, 12 Drawing Figures

FIG. 3
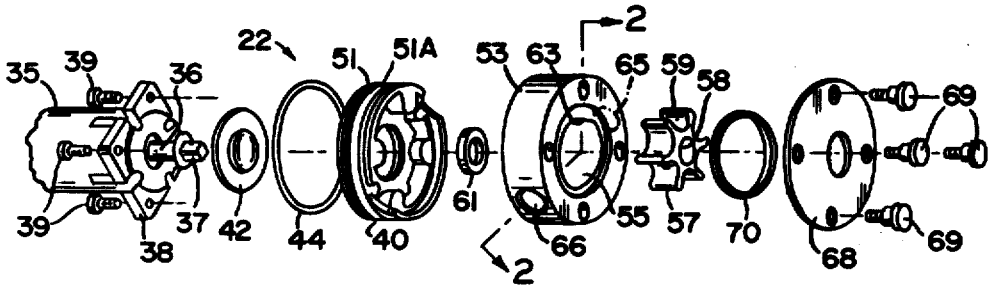
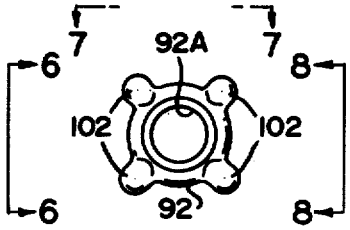
FIG. 5
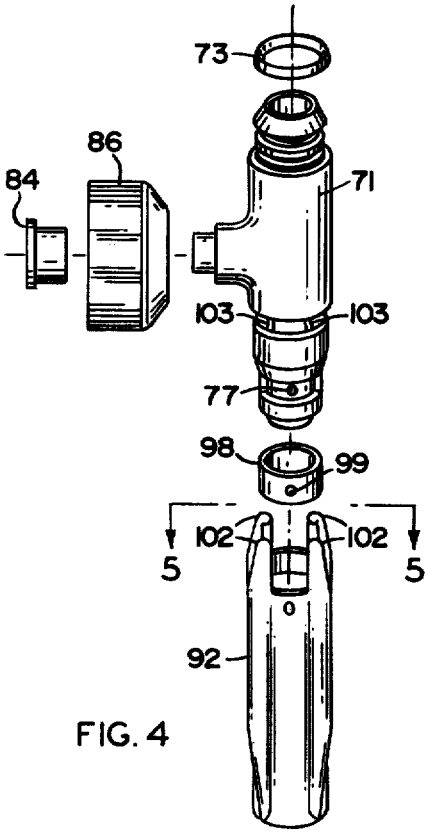
FIG. 4
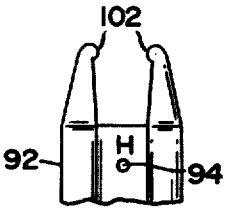
FIG. 6
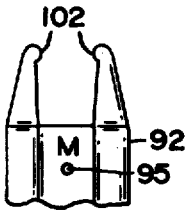
FIG. 7
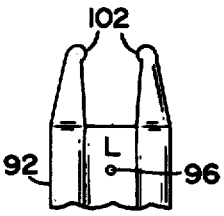
FIG. 8
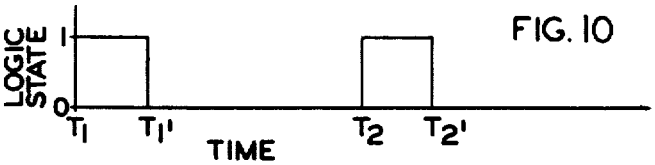
FIG. 10
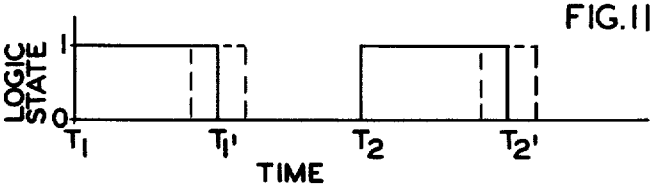
FIG. 11
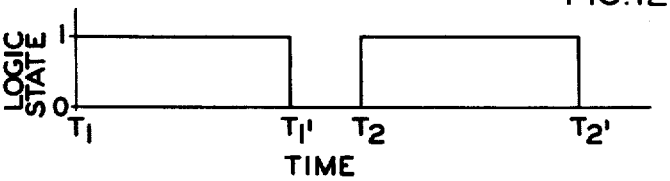
FIG. 12

LIQUID MIXING AND AERATING SYSTEM

This is a division of application Ser. No. 768,612, filed Feb. 14, 1977.

BACKGROUND OF THE INVENTION

1. Field of the Invention

This invention relates to a system for mixing liquids and more particularly, to a system for mixing and aerating first and a second liquid which may appear in the form of a concentrate and a diluent. The invention also relates to a liquid pump having a pumping chamber defined by a pumping wall in combination with a pumping rotor having a plurality of pumping elements.

2. Description of the Prior Art

The prior art has known many mixing systems for dispensing single or plural liquids. Among the prior art are systems for mixing a first liquid diluent with a second liquid concentrate in accordance with a predetermined relationship. One important application for such a device is the mixing of food products including fruit and vegetable juices and the like. In many cases, a juice concentrate such as orange or pineapple juice is frozen for later use. The thawed concentrate is then mixed with a diluent, usually water, in a predetermined volumetric relation, in order to produce an end product equivalent in consistency and flavor to the original fruit or vegetable juice.

When dealing with food products, various design problems are encountered in order to make the device readily accessible for cleaning after each use. One particular problem area is the pump used for pumping the concentrate. The pump must be designed to facilitate cleaning of the internal portion of the pump. As a consequence of these requirements, peristaltic pumps were popular in the prior art for pumping a liquid food concentrate. These pumps performed well, and included the advantages of simplicity and low cost. However, the peristaltic pumps had the distinct disadvantage of their relatively large physical size and limited variation in flow rate. Consequently the flow rate of the diluent had to be controlled in order to obtain different concentrate-diluent ratios for various fruit and vegetable products. A further disadvantage of the peristaltic pump was the pulsating liquid flow, the noisy operation and limited life of the deformable tubing in the peristaltic pump.

Therefore, it is an object of this invention to provide a liquid pump which overcomes the aforementioned disadvantages of the prior art peristaltic pump and comprises a pumping rotor moveably mounted within a pumping chamber defined by a pumping wall with the pumping rotor cooperating with the pumping wall for pumping the liquid upon rotation of the pumping rotor.

Another object of this invention is to provide a liquid pump comprising a motor housing member secured to the motor and having a first mounting portion and a rotor housing member having a second mounting portion with locking means detachably locking the rotor housing member to the motor housing member.

Another object of this invention is to provide a liquid pump having a rotor housing member including a pumping chamber portion and a chamber sealing portion removably mounted to the pumping chamber portion to enable access to a pumping rotor for cleaning the internal portions of the liquid dispenser pump.

Another object of this invention is to provide a liquid pump comprising a motor, a motor housing member and a rotor housing member wherein said motor is removably mounted within the system and wherein the motor housing member is mounted to the rotor housing member in a snap-locking engagement for enabling rapid disassembly for cleaning.

A further disadvantage of the prior art application of the peristaltic pump to liquid systems was the limited speed range of the peristaltic pump. In many cases, it is desirable to have a plurality of concentrate diluent volumetric ratios in order to accommodate different products having different concentrate-diluent relationships. The peristaltic pump and the prior art power supplies were incapable of providing the speed range required for accommodating various concentrate-diluent ratios. As a result, the flow rate of the liquid diluent would have to be controlled in order to adapt to various ratios of concentrate to diluent.

Therefore, it is an object of this invention to provide a circuit for controlling a device connected to flow means for controlling the flow of a first liquid and a pump for pumping a second liquid for enabling simultaneous flow of the first and second liquids in accordance with a predetermined volumetric relationship of the first and second liquids.

Another object of this invention is to provide a circuit for controlling a pump including a generator for generating a plurality of electrical pumping signal values and means for selecting one of the plurality of electrical pumping signal values for connection to the pump for providing a plurality of selectable pumping speeds.

Another object of this invention is to provide a circuit for controlling a device having flow means for controlling the flow of a first liquid and a pump for pumping a second liquid with the pumping speed of the pump established in accordance with the flow rate of the first liquid and in accordance with a preselected volumetric relationship of the first and second liquids.

Another object of this invention is to provide a circuit for controlling a device having flow means for controlling the flow of a first liquid and a pump for pumping a second liquid including a pulse width modulation generator for generating a plurality of preselected electrical pumping signals in accordance with the value of modulation of the pulse width modulation generator.

Some of the prior art devices incorporated aerator devices for aerating the flowing liquid. In general, these aerator devices were complex and incapable of rapid and accurate variation in magnitude of aeration in accordance with a preferred standard. A further disadvantage of the prior art aerator devices was the difficulty of cleaning the aerator devices.

Therefore, it is a further object of this invention to provide an aerator for aerating a flowing liquid having a first member with a fluid passage including a venturi orifice in cooperation with a second member being moveable relative to the first member and having a plurality of metering orifices communicable with the venturi orifice upon selected relative movement between the first and second members for metering the air flow to the venturi to control the aeration of the flowing liquid.

Another object of this invention is to provide an aerator for aerating a flowing liquid comprising a first and a second modular member adapted for relative rotation therebetween, the first member being adapted for receiving the flowing liquid and the second member being adapted for dispensing the flowing liquid.

Another object of this invention is to provide an aerator for aerating a flowing liquid having a plurality of aeration value levels upon selected rotation of the first member relative to a second member and detent means established between the first and second member for enabling orientation of the selected aeration values for the dispenser.

A further object of this invention is to provide a method of mixing a liquid concentrate and a liquid diluent in accordance with a predetermined volumetric relation which, in its preferred form incorporates the aforementioned apparati.

A further object of this invention is to provide a mixing system for mixing a first liquid diluent with a second liquid concentrate wherein the first and second liquids are mixed in a preferred volumetric relationship and aerated and wherein the system is made up of modular components, each being readily removable from one another enabling the system to be readily cleaned and maintained.

A further object of this invention is to provide a system incorporating molded plastic parts adapted for connection to one another by compression and O-ring gaskets.

Further objects of this invention will become obvious from the summary of the invention and the description of the preferred embodiment taken in conjunction with the claims and the appended drawings.

SUMMARY OF THE INVENTION

The invention may be incorporated into a system for mixing a first and a second liquid, comprising in combination, regulating means for regulating the flow of the first liquid. Pumping means for pumping the second liquid is provided with control means controlling the pumping means in accordance with the flow of the first liquid to maintain a given volumetric relationship between the first liquid and the second liquid. Mixing means mixes the first and second liquids in accordance with the aforementioned relationship.

The invention may also be incorporated into a circuit for controlling a device having flow means for controlling the flow of a first liquid and pumping means for pumping a second liquid comprising in combination, generator means for generating an electrical pumping signal. First means connects the generator means to the pumping means for pumping the second liquid in accordance with the electrical pumping signal. Activator means is connected to the flow means and the generator means for activating simultaneous flow and pumping of the first and second liquids upon a selected signal from the activator means.

The invention may also be incorporated into a liquid pump comprising in combination, a motor having a motor shaft with a motor housing member having a first mounting portion mounted to the motor. A pumping rotor is engageable with the motor shaft and has a plurality of pumping elements extending radially from the motor shaft. A rotor housing member has a pumping chamber defined by pumping wall means with an input and an output aperture communicating with the pumping chamber. The pumping chamber is adapted to receive the pumping rotor means with the pumping elements cooperating with the pumping wall means for pumping the liquid from the input aperture to the output aperature upon rotation of the motor shaft. The rotor housing member has a second mounting portion. The invention includes locking means mounted to at least one of the first and second mounting portions for detachably locking the rotor housing member to the motor housing member.

The invention may also comprise aerating means for aerating a flowing liquid comprising in combination, a first member having a first passage including venturi means therein. The first member has the venturi orifice located in proximity to the venturi means. A second member has a plurality of metering orifices therein. One of the first and second members is adapted for directing the flowing liquid to the venturi means. Means are provided for mounting the first and second members for enabling selected relative movement between the first and second members with each of the metering orifices being communicable with the venturi orifice upon selected relative movement between the first and second members for metering the air flow to the venturi means to control aeration of the flowing liquid.

The invention may also be incorporated into the method of mixing a concentrate and a liquid diluent in accordance with a predetermined volumetric relation comprising the steps of regulating the flowing liquid diluent. The concentrate is then pumped in accordance with the flow of the liquid diluent and in accordance with a predetermined volumetric relation. The method includes mixing and aerating the mixture of the concentrate and the diluent.

Other objects and a fuller understanding of the invention may be had by reference to the description of the preferred embodiment taken in conjunction with the accompanying drawings and the claims.

BRIEF DESCRIPTION OF THE DRAWINGS

FIG. 3 is an elevational exploded view of pertinent portions of the pump shown in FIGS. 1 and 2;

FIG. 4 is an elevational exploded view of the mixer and aerator shown in FIGS. 1 and 2;

FIG. 5 is a view along line 5—5 in FIG. 4 of a portion of the mixer shown in FIG. 4;

FIG. 6 is a view along line 6—6 of the member shown in FIG. 5;

FIG. 7 is a view along line 7—7 of the member shown in FIG. 5;

FIG. 8 is a view along line 8—8 of the member shown in FIG. 5;

FIG. 10 is a graph illustrating a first electrical pumping signal generated by the control circuit shown in FIG. 9;

FIG. 11 is a graph illustrating a second electrical pumping signal generated by the control circuit means shown in FIG. 9; and FIG. 12 is a graph illustrating a third electrical pumping signal generated by the control circuit shown in FIG. 9.

DESCRIPTION OF THE PREFERRED EMBODIMENT

Figure 1:
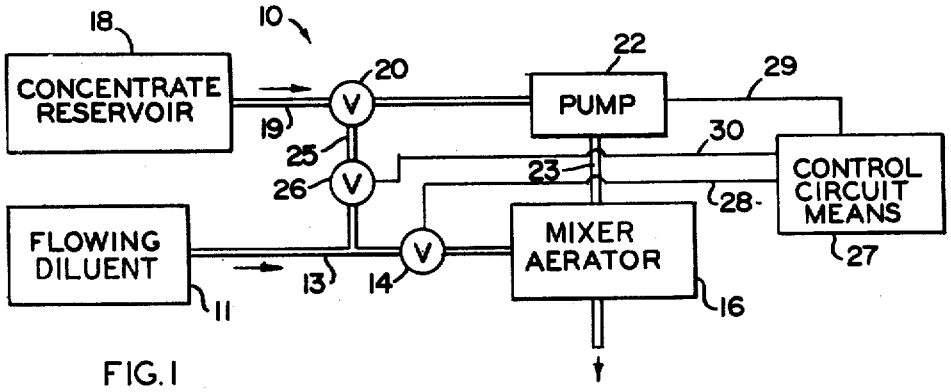
FIG. 1 is a block diagram of a system for dispensing a first and a second liquid in accordance with the instant invention.

Similar reference numerals refer to similar parts in the Figs wherein FIG. 1 represents a system for mixing a first and a second liquid wherein the first liquid may be a diluent such as water and the second liquid may be a concentrate such as fruit or vegetable concentrate. The concentrate may be prepared from an original juice by removing a portion of the water content and freezing the concentrate for use at a later time. The instant invention provides means for recombining the concentrate with the water diluent to provide an end product with substantially identical properties and flavor as the original fruit or vegetable food product. The system 10 comprises a source of diluent 11, which may be a conventional water supply source. The first liquid from the flowing diluent 11 is connected by regulating means shown as conduit 13 and valve 14 to a mixer and aerator 16. A concentrate reservoir 18 which keeps the concentrate in a refrigerated state is connected by conduit 19 and check valve 20 to a pump 22 for pumping the second liquid concentrate from reservoir 18 through conduit 23 to the mixer-aerator 16. The flowing diluent is also connected through a conduit 25 and valves 26 and check valve 20 for purging the concentrate from pump 22, conduit 23 and the mixer-aerator 16 as will be hereinafter described. Control means 27 is connected by connectors 28 and 29 to valve 14 and pump 22, respectively. The control means 27 is also connected to valve 26 by connector 30.

The flowing diluent, which may be water under a regulated pressure of 20 lbs. per sq. inch, is further regulated by the condition of valve 14 controlled by control means 27. Pumping of the second liquid concentrate from reservoir 18 is controlled by the status of valve 20 and the speed of the pump 22. Valve 20 in this embodiment is controlled by positive pressure and gravity operating on a check ball (not shown) within valve 20. Without any pressure in conduit 25, the action of gravity will cause the check ball to close the connection between the reservoir 18 and the pump 22. Positive pressure in conduit 25 will further close the check ball, allowing connection between conduit 25 and the pump 22 but preventing connection between conduit 25 and conduit 19, preventing the diluent from entering the concentrate reservoir during the purging of the pump 22, conduit 23 and mixer-aerator 16. When valve 26 is closed, pump 22 will lower the pressure in conduit 25 lifting the check ball and pump the liquid concentrate from reservoir 18 to the mixer aerator 16.

Control means 27 is established to provide simultaneous activation of valve 14 and pump 22 when valve 26 is in the closed position for dispensing the mixed and aerated first and second liquids. The speed of pump 22 is established in accordance with the flow rate of the flowing diluent and in accordance with a preestablished volumetric relationship, depending upon the type of liquid concentrate used. For example conventional tomato juice is mixed on a preferred volumetric relationship of three parts of diluent to one part concentrate (3 to 1) whereas orange juice is mixed in a preferred volumetric relationship of (3.6 to 1). The speed of pump 22 must be selected in accordance with the flow rate of the liquid diluent in addition to the preferred volumetric relationship of the particular concentrate in the reservoir 18. The flow rate of the liquid diluent is, in part determined by the setting of a water pressure regulator in the water line to which the system 10 is connected which is represented by flowing diluent 11. Upon termination of mixing the concentrate, for example, at the end of a business day, control means 27 activates valve 26 and simultaneously energizes pump 22 to direct the diluent, such as water, through valves 26 and 20 to purge pump 22 and mixer-aerator 16 to clean the system.

Figure 2:
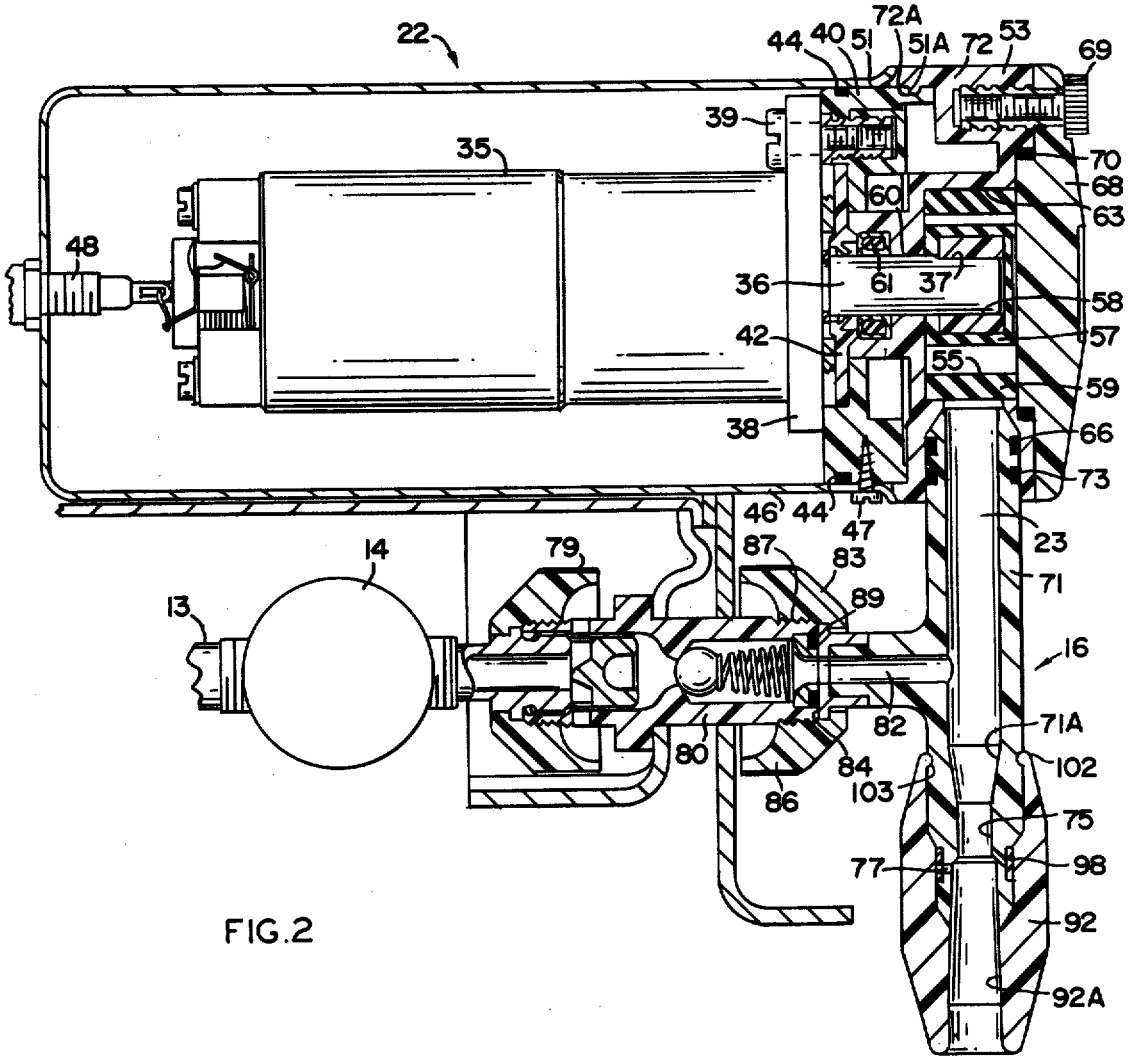
FIG. 2 is a side sectional view along line 2—2 in FIG. 3 of a portion of the invention shown in FIG. 1, illustrating in greater detail the pump, mixer and aerator.

FIG. 2 is a side sectional view along line 2—2 of FIG. 3 of a portion of the invention shown in FIG. 1 illustrating in greater detail the mixer-aerator 16 and the pump 22. FIG. 3 is an exploded isometric view of a portion of pump 22 whereas FIG. 4 is an exploded isometric view of a portion of the mixer-aerator 16. The pump 22 comprises a pumping portion and a motor portion a D.C. electric motor 35 having a motor shaft 36 including a shaft key 37. The motor 35 has a mounting boss 38 for receiving threaded fasteners shown as screws 39 to secure a pump housing member 40. A rubber gasket 42 seals the perimeter of shaft 36 whereas an O-ring gasket 44 seals the pump housing member 40 relative to a shield 46 shown in FIG. 3 which is secured to the pump housing member 40 by screws 47. A plug 48 secured to shield 46 provides electrical connection of motor 35 to the control 27 shown in FIG. 1. The pump housing member 40 includes a first mounting portion 51 which has a substantially circular member extending along a portion of shaft 36 and extending radially outward therefrom and having a recessed portion 51A. The first mounting portion extends substantially uniformly about shaft 36 but is not shown in FIG. 2 since the section is taken along line 2—2 of FIG. 3.

A rotor housing member 53 includes a projection 72A receivable in recess 51A and a pumping chamber 55 defined by pumping wall means and capable of receiving a rotor 57 having a central keyed aperture 58 and a plurality of pumping elements 59, shown as flexible vane rotor. The rotor housing member 53 includes an aperture 60 and a seal 61 for receiving a portion of shaft 36 within the pumping chamber 55 with the shaft key 37 cooperating with keyed aperture 58 of rotor 57 to rotate the rotor 57 in accordance with the rotation of shaft 36. The pumping chamber 55 defined by pumping wall means has the portion 63 which is displaced toward the axis of rotation of rotor 57 relative to the remaining portion of the pumping wall means. Thus, the axis of rotation is a first distance from a first portion of the pumping chamber wall and a second distance from a second portion of the pumping chamber wall. An input aperture 65 and an output aperture 66 are in communication with the pumping chamber 55. The rotor elements 57 flex when engaged with the portion 63 to enable pumping from the input aperture 65 to the output aperture 66 upon proper rotation of the rotor 57. The portion 63 enables a greater liquid volume to move from the input to the output aperture rather than the volume movement from the output to the input aperture. The pump operates on the principle of a flexible vane pump as is well known in the art.

A sealing portion or plate 68, preferably made of a transparent material, engages with rotor housing 53 by screws 69 with an interposed gasket 70 sealing the pumping chamber 55 with the rotor 57 contained therein. The transparent sealing plate enables visual observation of the pumping action in addition to visible inspection of the purging of the pump and the rotor 57.

The output aperture 66 receives the mixer-aerator 16 with the conduit 23 in FIG. 1 illustrated as part of a first member 71 sealed by O-ring gaskets 73. The first member 71 has a first fluid passage 71A with a venturi 75 contained in the first fluid passage 71A. A venturi orifice 77 is located in proximity to the venturi 75 to enable aeration of the flowing liquids as the liquids flow through the venturi 75.

Conduit 13 is connected through valve 14 shown as an electrically operated solenoid valve with coupling 79 interconnecting a check valve assembly 80 to fluid passage 82 which terminates into the first fluid passage 71A. The check valve assembly 80 prevents movement of the liquid concentrate into the valve 14 and the conduit 13 during a failure of line pressure of the flowing liquid diluent This eliminates any possibility of the concentrate entering the water line to insure a wholesome product. Coupling 83 secures surface 84 against the check valve assembly 80 with nut 86 coacting through threads 87 to apply the necessary pressure to deform a sealing gasket 89. Couplings 79 and 83 enables quick disconnection of the first member 71 from the check valve assembly 80 and the check valve assembly 80 from valve 14 to facilitate cleaning and maintenance.

A second member 92 includes a second fluid passage 92A and a plurality of metering orifices 94–96 shown in FIGS. 6–8. The second member 92 is mounted on the first member 71 with a gasket 98 being interposed therebetween with a gasket orifice 99 being oriented relative to the venturi orifice 77. The gasket 98 is secured to the first member 71 creating a seal between the first and second members 71 and 92. The second member 92 is rotatably mounted relative to the first member 71 for enabling communication between the venturi orifice 77 and a selected one of the metering orifices 94–96. The metering orifices 94, 95, and 96 are respectively labeled H(high), M(medium) and L(low). Fingers 102 on the second member 92 cooperate with detents 103 in the first member 71 enabling orientation of each one of the plurality of metering orifices 94–96 adjacent the venturi orifice 77. The position of the second member 92 shown in FIG. 4 is void of a metering orifice as indicated by the label O signifying an off position.

The restricted portion of the venturi 75 creates a high velocity to the flowing first and second liquids which are mixed at the junction of conduits 82 and 23. As the high velocity liquids enter the larger region, the lower pressure associated with the high velocity fluid draws air through the metering orifice and the venturi orifice to aerate the flowing liquids. Metering orifice 94, labeled H (high), provides the largest metering orifice enabling greatest air flow through the venturi orifice 77 to provide maximum aeration of the first and second liquids. Metering orifice 95, labeled M (medium) provides an intermediate metering orifice to provide a medium amount of aeration to the first and second liquids whereas the metering orifice 96, labeled L (low) provides a small metering orifice for the lowest amount of aeration of the first and second liquids. The fourth position of the second member 92 is void of an orifice labeled O (off) for providing substantially zero aeration to the first and second liquids.

It should be appreciated from the foregoing description that the system 10 has been made of modules detachable from one another to enable easy maintenance and cleaning. The electrical power plug 48 enables the entire motor and pump assembly enclosed in shield 46 to be removed from the remainder of the machine (not shown). The rotor housing member 53 is mounted to the motor housing member 51 in a snap inter-locking engagement as heretofore described. Sealing plate 68 is readily removable for removing rotor 57 from the pumping chamber 55. The first member 71 is removable from both the output aperture 66 of pump 22 and the check valve assembly 80. The second member 92 is readily detachable from the first member 71. FIG. 2 shows that the device incorporates various molded plastic parts making the device inexpensive, sanitary, and easy to maintain.

Figure 9:
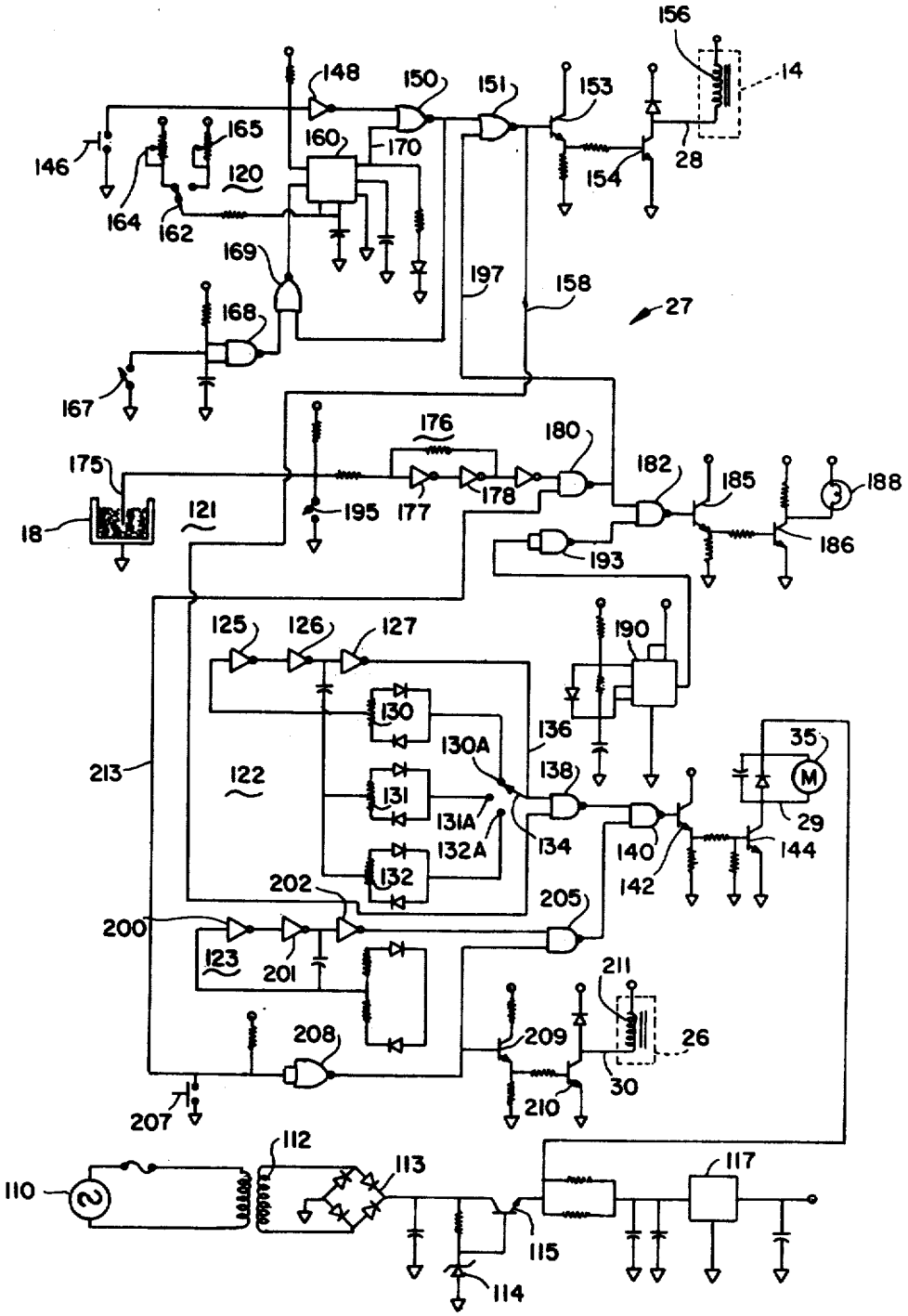
FIG. 9 is a schematic diagram of the control circuit shown in FIG. 1.

FIG. 9 is a schematic diagram of an electronic control circuit suitable for use as the control circuit means 27 shown in FIG. 1. The circuit operates from a source of power 110 shown as a conventional line voltage which is coupled through transformer 112 to a full wave bridge 113. Zener diode 114 and transistor 115 regulate the power supply voltage. An integrated circuit voltage regulator 117, typically a Fairchild 78M12 as set forth in the Fairchild Semiconductor Catalog 1974, is interposed between the filter capacitors to further regulate the voltage supply to the control portion of the circuit. The control circuit 27 may be divided into an activator circuit 120, a sensor circuit 121, a motor control circuit 122 and a purging circuit 123.

The motor control circuit 122 includes generating means for generating an electrical pumping signal for controlling motor 35. The preferred form of the generator is shown as a pulse width modulation generator comprising three Hex inverters 125-127 connected in conjunction with three potentiometers 130, 131 and 132. Each of the Hex inverters may incorporate a Fairchild CMOS F4069/34069 as set forth on page 4–129 of the Fairchild Semiconductor Catalog 1974, which catalog is here incorporated by reference. Each of the potentiometers 130–132 are connected by diodes to positions 130A, 131A and 132A of a switch 134. Selecting one of the positions 130A–132A connects one of the potentiometers 130–132 and associated diodes across the output of the Hex inverters 125–127. The wave forms produced by the Hex inverters on conductor 136 are shown in FIGS. 10, 11 and 12, respectively. The commencement of each of the pulses shown in FIGS. 10–12 is represented by $T_1$ and $T_2$ whereas the termination of each of the pulses is represented by $T_1'$ and $T_2'$. The duration between the commencement of the pulses for each of FIGS. 10–12 is constant and only the termination of the pulses is varied in accordance with the state of switch 134 and the settings of potentiometers 130–132. Accordingly, the pulse duration between $T_1$ and $T_1'$ represents the pulse percentage of the constant duration between $T_1$ and $T_2$. FIG. 10 represents a small duration pulse for providing a low effective voltage to motor 35. FIG. 11 represents an intermediate effective voltage and FIG. 12 represents a high effective voltage to power motor 35 or the electrical conduction per unit time. Adjustment of each of the potentiometers 130-132 adjusts the duration of the pulse between $T_1$ and $T_2$. For example, adjustment of potentiometer 131 will increase or decrease the pulse length as shown in phantom in FIG. 11.

The output on connector 136 is applied to NAND gate 138 which is connected through a NAND gate 140 to control transistor 142. The emitter output of transistor 142 controls power transistor 144 to provide D.C. electrical power to motor 35. When NAND gates 138 and 140 are enabled, power in accordance with one of the waveforms shown in FIGS. 10–12 is applied to motor 35 to enable pumping of the liquid concentrate.

The activator circuit 120 comprises a pushbutton switch 146 coupled through an inverter 148, which may be a Fairchild F4069/34069, and coupled through NOR gates 150 and 151 to control transistor 153. The emitter output of transistor 153 is connected to power transistor 154 which controls D.C. current to coil 156 of the solenoid operated valve 14 shown in FIGS. 1 and 2. The output of NOR gate 151 is also connected by conductor 158 to enable NAND gate 138, when the signal from pushbutton switch 146 is passed by NOR gates 150 and 151. Thus closing switch 146 will provide simultaneous flow and pumping of the first and second liquids.

The activator circuit 120 also includes a timer circuit including a timer 160 shown as a Fairchild 556 dual timing integrated circuit. This circuit is disclosed in the aforementioned Fairchild Semiconductor catalog. A switch 162 is connected to couple the timing circuit 160 to either potentiometer 164 or potentiometer 165. A switch 167 is connected through NAND gate 168 and NOR gate 169 to energize timing circuit 160. The output of timing circuit 160 is applied on connector 170 to NOR gate 150. The timing circuit 160 operates to enable NOR gates 150 and 151 and NAND gate 138 for a predetermined period of time after a momentary contact of pushbutton switch 146. The preselected duration is selectable by switch 162 between a first and a second duration with each duration being variable in time through potentiometers 164 and 165. Potentiometer 164 may be adjusted to provide simultaneous flow and pumping of the first and second liquids for a short duration sufficient to fill a small container upon a momentary contact of switch 146. Potentiometer 165 may be adjusted to provide a long duration sufficient to fill a larger container upon a momentary contact of switch 146. Switch 162 selects either the short or long duration whereas switch 167 activates or deactivates timing circuit 160.

Sensor circuit 121 includes a probe 175 immersed within the liquid concentrate contained in the reservoir 18, which reservoir is shown attached to electrical ground. The probe is connected to a Schmitt trigger 176 formed by integrated circuits 177 and 178 (Fairchild F4069/34069). The output of the Schmitt trigger 176 is applied to NAND gate 180 with the output of NAND gate 180 being applied to the input of NOR gate 151 and also to the input of NAND gate 182. The output of NAND gate 182 controls transistors 185 and 186 for supplying power to a lamp 188. A timing circuit 190 shown as a Fairchild 555 integrated circuit is connected through NAND gate 193 to provide a periodic signal between a 0 and 1 logic state which is applied to NAND gate 182. When the liquid concentrate is below the level of probe 175, probe 175 is no longer at ground potential which triggers Schmitt trigger 176 and enables NAND gate 182. The periodic signal from timing circuit 190 flashes lamp 188. Switch 195 is a manual override for the sensor circuit 12 which keeps the input to Schmitt trigger 176 grounded when switch 195 is in the closed position. The output of NAND gate 180 is connected by connector 197 to disable NOR gate 151. Disabling NOR gate 151 prevents operation of solenoid 14 and disables NAND gate 138 to block the output from Hex inverters 125–127. This ensures that valve 14 and pump 22 are not energized if there is an insufficient amount of liquid concentrate in reservoir 18.

The purging circuit 123 comprises a pulse generator including three Hex inverter circuits 200–202 connected in a manner similar to Hex inverters 125–127. Similar Hex inverters may be used in both circuits. The output of Hex inverters 200–202 is applied to NAND gate 205 with the output of NAND gate 205 being connected to NAND gate 140. A pushbutton switch 207 is connected through NOR gate 208 to the other input of NAND gate 205. The output of NOR gate 208 is also connected through transistors 209 and 210 to power coil 211 of solenoid operated valve 26. Pushbutton switch 207 is also connected through conductor 213 to NAND gate 180. When switch 207 is closed, NAND gate 205 is enabled passing the generated pulse signal from Hex inverters 200–202 to drive motor 35 through NAND gate 140. Concomitantly therewith, valve 26 is activated allowing the diluent to flow through valve 20 thereby purging the pump 22 and the mixer aerator 16. The signal applied on conductor 213 disables NAND gate 180 to prevent operation of solenoid 14.

The operation of the control means 27 within the dispensing system 10, may be briefly described as starting by closing of switch 146 which activates valve 14 and NAND gate 138 for supplying an electrical pumping signal to motor 35 of pump 22. The speed of pump 22 can be adjusted by potentiometers 130–132 for varying the effective voltage per unit time for controlling the pumping speed in accordance with the flow rate of the flowing diluent. Switch 134 enables changing of the pumping speed in accordance with a given volumetric relation for a particular type of concentrate. In this example, the motor circuit control 122 is capable of accommodating three distinct dilutent to concentrate ratios. Closing of switch 167 activates the timing circuit 160 thereby enabling a momentary closing of switch 146 to energize valve 14 and pump 22 for a preselected period of time. For example, potentiometers 164 and 165 may be adjusted to completely fill a small and large beverage glass, respectively, upon a momentary contact from switch 146. The timing circuit 160 is optimal. The sensor circuit 121 disables the activator circuit 120 at NOR gate 151 when the level of the liquid concentrate is reduced below the level of probe 175. Simultaneously therewith, lamp 188 flashes to indicate a low level of concentrate in the reservoir 18. Closing of switch 207 opens valve 26 and enables a signal from Hex inverters 200-202 to energize motor 35 thereby pumping diluent through pump 22 and the mixer-aerator 16 for cleaning the device. A signal on connector 213 prevents opening of valve 14.

The invention may also be incorporated into the method of mixing a concentrate and a liquid diluent in accordance with a predetermined volumetric relation comprising the step of regulating the flow of liquid diluent by valve 14 and pumping the concentrate by pump 22 in accordance with the flow of liquid diluent and a predetermined volumetric relation. The method includes mixing the concentrate and the diluent in the first member 71 and aerating the mixture of the concentrate and diluent through venturi 75. The mixture is dispensed through the second fluid passage 92A. The pumping speed may be adjusted by the empirical process of pumping the concentrate concurrently with the flow of liquid diluent to provide a sample. The volumetric relation may be determined by the use of a refractometer which measures the quantity of soluble solids in the liquid as is well known in the art. The appropriate potentiometer may then be adjusted in accordance with the results from the refractometer. The empirical process may be repeated until an accurate volumetric relation is obtained in the end product.

The present disclosure includes that contained in the appended claims as well as that in the foregoing description. Although this invention has been described in its preferred form with a certain degree of particularity, it is understood that the present disclosure of the preferred form has been made only by way of an example and numerous changes in details of construction, and arrangement of circuit elements and parts may be resorted to without departing from the spirit and scope of the invention.

Now that the invention has been described:

What is claimed is:

1. A system for mixing a first liquid diluent and a second liquid concentrate in a fluid passage comprising in combination:

regulating means for regulating the flow of the first liquid;

pumping means for pumping the second liquid;

control means for controlling said pumping means and varying the pumping rate thereof in accordance with the flow of the first liquid to maintain a given volumetric relationship between the first liquid and the second liquid;

mixing means for mixing said given volumetric relationship of said first and second liquids enabling the mixture to flow from the fluid passage;

said regulating means including valve means disposed in a conduit connecting the first liquid to said mixing means;

means connecting said control means to said valve means for simultaneously energizing and deactivating said valve means and said pumping means in response to an electrical signal from the control means for controlling the flow rate of the first liquid and the pumping of the second liquid;

said mixing means comprising intersecting conduits extending from said pumping means and said valve means to mix the first and second liquids therein; and one way valve means interposed in said conduit between said intersection of said conduits and said valve means for prohibiting the second liquid concentrate from entering said value means and the source of said first liquid diluent.

2. A system as set forth in claim 1, including means for purging said pumping means and said mixing means upon termination of mixing the first and second liquids; and said purging means comprising means for directing the first liquid diluent to flow through said pumping means and said mixing means for cleaning the system thereby.

3. A system for mixing a first liquid diluent and a second liquid concentrate in a fluid passage comprising in combination:

regulating means for regulating the flow of the first liquid;

pumping means for pumping the second liquid;

control means for controlling said pumping means and varying the pumping rate thereof in accordance with the flow of the first liquid to maintain a given volumetric relationship between the first liquid and the second liquid;

mixing means for mixing said given volumetric relationship of said first and second liquids enabling the mixture to flow from the fluid passage;

said regulating means including valve means disposed in a conduit connecting the first liquid to said mixing means;

means connecting said control means to said valve means for simultaneously energizing and deactivating said valve means and said pumping means in response to an electrical signal from the control means for controlling the flow rate of the first liquid and the pumping of the second liquid;

said mixing means comprising intersecting conduits extending from said pumping means and said valve means to mix the first and second liquids therein;

one way valve means interposed in said conduit between said intersection of said conduits and said valve means for prohibiting the second liquid concentrate from entering said value means and the source of said first liquid diluent;

variable aerator means comprising a first member having venturi means;

a venturi orifice in said first member in proximity to said venturi means; and a second member movably mounted relative to said first member having a plurality of metering orifices therein, each of said metering orifices being communicable with said venturi orifice upon selected movement of said second member relative to said first member for metering air flow to the liquids through said venturi means.

4. A system for mixing a first liquid diluent and a second liquid concentrate in a fluid passage comprising in combination:

regulating means for regulating the flow of the first liquid;

pumping means for pumping the second liquid;

said pumping means includes a housing having a pumping chamber defined by pumping chamber wall means;

a rotor having a plurality of flexible members extending from the axis of rotation of said rotor;

said rotor being mounted in said pumping chamber with the axis of rotation of said rotor means being a first distance from a first portion of said pumping chamber wall means and being a second distance from a second portion of said pumping chamber wall means;

control means for controlling said pumping means and varying the pumping rate thereof in accordance with the flow of the first liquid to maintain a given volumetric relationship between the first liquid and the second liquid;

mixing means for mixing said given volumetric relationship of said first and second liquids enabling the mixture to flow from the fluid passage;

said regulating means including valve means disposed in a conduit connecting the first liquid to said mixing means;

means connecting said control means to said valve means for simultaneously energizing and deactivating said valve means and said pumping means in response to an electrical signal from the control means for controlling the flow rate of the first liquid and the pumping of the second liquid;

said mixing means comprising intersecting conduits extending from said pumping means and said valve means to mix the first and second liquids therein;

one way valve means interposed in said conduit between said intersecting of said conduits and said valve means for prohibiting the second liquid concentrate from entering said value means and the source of said first liquid diluent;

variable aerator means comprising a first member having venturi means;

a venturi orifice in said first member in proximity to said venturi means;

a second member movably mounted relative to said first member having a plurality of metering orifices therein;

each of said metering orifices being communicable with said venturi orifice upon selected movement of said second member relative to said first member for metering air flow to the liquids through said venturi means;

means for purging said pumping means and said mixing means upon terminaton of mixing the first and second liquids; and said purging means comprising means for directing the first liquid diluent to flow through said pumping means and said mixing means for cleaning the system thereby.

5. A system for mixing a first liquid diluent and a second liquid concentrate in a fluid passage comprising in combination:

regulating means for regulating the flow of the first liquid;

pumping means for pumping the second liquid;

said pumping means includes a pumping portion and a motor portion;

a first mounting on said pumping portion and a second mounting on said motor portion;

said first and second mountings being engageable with one another in a snap interlocking relation enabling said pumping portion to be readily removed from said motor portion for cleaning said pumping portion;

control means for controlling said pumping means and varying the pumping rate thereof in accordance with the flow of the first liquid to maintain a given volumetric relationship between the first liquid and the second liquid;

mixing means for mixing said given volumetric relationship of said first and second liquids enabling the mixture to flow from the fluid passage;

said regulating means including valve means connecting the first liquid to said mixing means;

means connecting said control means to said valve means for simultaneously energizing and deactivating said valve means and said pumping means for controlling the flow of the first and second liquids.

6. A system for mixing a first liquid diluent and a second liquid concentrate in a fluid passage comprising in combination;

regulating means for regulating the flow of the first liquid;

pumping means for pumping the second liquid;

said pumping means including a rotor housing having at least a partially cylindrical pumping chamber for receiving a rotary pumping element therein;

said pumping chamber having a rear wall and a side wall with an input and output disposed in said side wall;

a housing plate engageable with said rotor housing for enclosing the front of said pumping chamber;

and means for removably mounting said housing plate from said rotor housing for enabling cleaning of said rotary pumping element while said rotary pumping element is disposed in said pumping chamber and while the input and the output of the pumping chamber are connected to the system;

control means for controlling said pumping means and varying the pumping rate thereof in accordance with the flow of the first liquid to maintain a given volumetric relationship between the first liquid and the second liquid;

mixing means for mixing said given volumetric relationship of said first and second liquids enabling the mixture to flow from the fluid passage;

said regulating means including valve means connecting the first liquid to said mixing means; and means connecting said control means to said valve means for simultaneously energizing and deactivating said valve means and said pumping means for controlling the flow of the first and second liquids.

7. A system as set forth in claim 6 wherein said housing plate is transparent to enable visual inspection of said rotary pumping element.

* * * * *

UNITED STATES PATENT AND TRADEMARK OFFICE

CERTIFICATE OF CORRECTION

PATENT NO. : 4,194,650

DATED : March 25, 1980

INVENTOR(S) : James E. Nottke et al

It is certified that error appears in the above-identified patent and that said Letters Patent are hereby corrected as shown below:

In the Abstract, line 5, "liquids" should be --liquid--: "fthe" should be --the--.

Col. 1, line 11, after "ing" insert --a--
line 18, delete "dispensing single or" and insert --mixing--

Col. 4, line 6, "aerating" should be --aerator--;

Col. 10, line 19, delete --dispensing--;
Col. 11, line 44, delete "value" and insert --valve--;
Col. 12, line 16, delete "value" and insert --valve--;

Col. 13, line 1, delete "value" and insert --valve--.

Signed and Sealed this

*Twenty-sixth* Day of *August 1980*

[SEAL]

*Attest:*

SIDNEY A. DIAMOND

*Attesting Officer* *Commissioner of Patents and Trademarks*

REEXAMINATION CERTIFICATE (751st)

United States Patent [19]

Nottke et al.

[11] B1 4,194,650

[45] Certificate Issued Aug. 25, 1987

[54] LIQUID MIXING AND AERATING SYSTEM

[75] Inventors: James E. Nottke, Seminole; Jack K. Ruebel, Clearwater, both of Fla.

[73] Assignee: Lykes Pasco Packing Co. Dispenser Manufacturing Div., Clearwater, Fla.

Reexamination Request:
No. 90/001,136, Dec. 9, 1986

Reexamination Certificate for:

| | |
|---|---|
| Patent No.: | **4,194,650** |
| Issued: | **Mar. 25, 1980** |
| Appl. No.: | **882,658** |
| Filed: | **Mar. 2, 1978** |

Certificate of Correction issued Aug. 26, 1980.

Related U.S. Application Data

[62] Division of Ser. No. 768,612, Feb. 14, 1977, abandoned.

[51] Int. Cl.[4] ..... B67D 1/10

[52] U.S. Cl. ..... 222/57; 222/133; 222/148; 239/428.5

[58] Field of Search ..... 222/57, 59, 129.1, 129.2, 222/129.3, 129.4, 133, 145

[56] References Cited

U.S. PATENT DOCUMENTS 3,240,154 3/1966 Robbins ..... 418/149 X

*Primary Examiner*—Joseph Rolla

[57] ABSTRACT

A liquid mixing and aeration system is disclosed comprising a novel liquid pump, a electronic circuit for controlling the system, and improved mixing for mixing flowing liquids. The system enables mixing of a first and a second liquids regulating the flow of the first liquid. A liquid pump is connected for pumping the second liquid. A control circuit controls the pump in accordance with the flow of the first liquid to maintain a given volumetric relationship between the first liquid and the second liquid. A mixer mixes the first and second liquid in accordance with the aforementioned volumetric relationship.

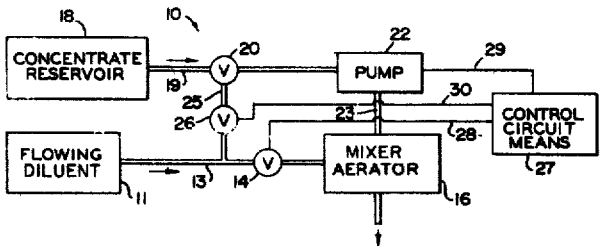

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *

.5 SR
XR 4,194,650

ATION CERTIFICATE (1007th)

United States Patent [19]
Nottke et al.
[11] B2 4,194,650
[45] Certificate Issued Jan. 31, 1989

[54] LIQUID MIXING AND AERATING SYSTEM

[75] Inventors: James E. Nottke, Seminole; Jack K. Ruebel, Clearwater, both of Fla.

[73] Assignee: Lykes Pasco Packing Co. Dispenser Manufacturing Div., Clearwater, Fla.

Reexamination Request:
No. 90/001,377, Nov. 16, 1987

Reexamination Certificate for:

| | |
|---|---|
| Patent No.: | 4,194,650 |
| Issued: | Mar. 25, 1980 |
| Appl. No.: | 882,658 |
| Filed: | Mar. 2, 1978 |

Certificate of Correction issued Aug. 26, 1980.

Related U.S. Application Data

[62] Division of Ser. No. 768,612, Feb. 14, 1977.

[51] Int. Cl.[4] ..... B67D 1/10
[52] U.S. Cl. ..... 222/57; 222/133; 222/148; 239/428.5
[58] Field of Search ..... 222/57, 59, 129.1, 129.2, 222/129.3, 129.4, 133, 145

[56] References Cited

U.S. PATENT DOCUMENTS

| | | | |
|---|---|---|---|
| 3,240,154 | 3/1966 | Robbins . | |
| 3,323,681 | 6/1967 | DiVette . | |
| 3,528,587 | 9/1970 | Popinski . | |
| 3,642,171 | 2/1972 | Ernst | 222/59 |

*Primary Examiner*—Kevin P. Shaver

[57] ABSTRACT

A liquid mixing and aeration system is disclosed comprising a novel liquid pump, a electronic circuit for controlling the system, and improved mixing for mixing flowing liquids. The system enables mixing of a first and a second liquids regulating fthe flow of the first liquid. A liquid pump is connected for pumping the second liquid. A control circuit controls the pump in accordance with the flow of the first liquid to maintain a given volumetric relationship between the first liquid and the second liquid. A mixer mixes the first and second liquid in accordance with the aforementioned volumetric relationship.

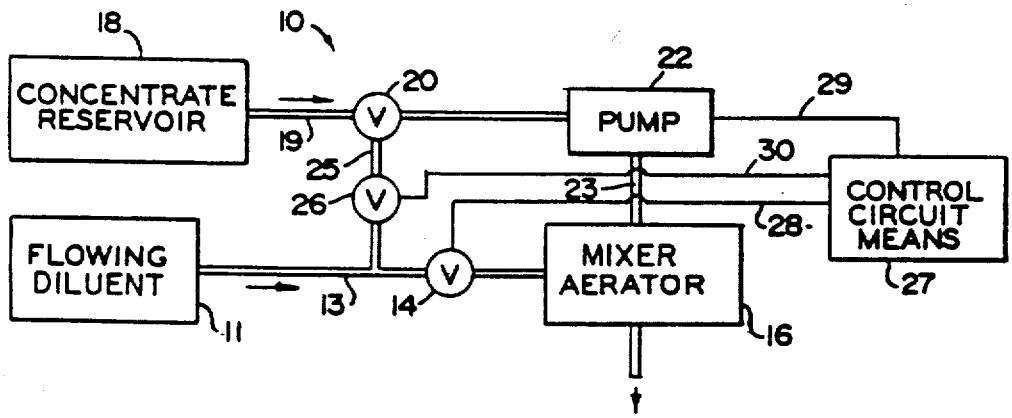

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *